United States Patent [19]

Fukuda

[11] Patent Number: 4,511,893

[45] Date of Patent: Apr. 16, 1985

[54] METHOD OF STORING IMAGES IN THE FORM OF CONTOURS AND PHOTO-TYPESETTING APPARATUS THEREOF

[75] Inventor: Shinichiro Fukuda, Tokyo, Japan

[73] Assignee: Shaken Co., Ltd., Tokyo, Japan

[21] Appl. No.: 348,160

[22] Filed: Feb. 12, 1982

[51] Int. Cl.[3] ..... G09G 1/16

[52] U.S. Cl. ..... 340/747; 340/728; 340/751; 340/734; 346/160.1; 354/6

[58] Field of Search ..... 340/723, 727, 747, 734, 340/751, 728; 364/518, 519, 520, 521, 168, 169; 346/153.1, 160, 160.1, 161; 354/6, 7, 12, 13

[56] References Cited

U.S. PATENT DOCUMENTS

| | | | |
|---|---|---|---|
| 3,609,319 | 9/1971 | Clifford, Jr. et al. | 364/169 |
| 3,675,231 | 7/1972 | Bezrodny | 340/743 |
| 4,199,815 | 4/1980 | Kyte et al. | 340/747 |

*Primary Examiner*—Marshall M. Curtis

*Attorney, Agent, or Firm*—Sherman & Shalloway

[57] ABSTRACT

Method and apparatus for storing and photo-typesetting characters and figures stored in the form of data of contours wherein unlike the conventional art, curves of contours are not approximated by straight lines, but are approximated by curves, that is, the data is stored to obtain a curve which is approximated to the curve of contour approximated to contours such as of characters and figures being reproduced based upon the stored data.

7 Claims, 5 Drawing Figures

METHOD OF STORING IMAGES IN THE FORM OF CONTOURS AND PHOTO-TYPESETTING APPARATUS THEREOF

BACKGROUND OF THE INVENTION

1. Field of the Invention

The present invention relates to a method of storing characters and figures, and to a photo-typesetting apparatus which projects characters and figures onto a sensitive material using a cathode-ray tube (CRT), laser scanner or other flying spot character imaging device.

2. Description of the Prior Art

In recent years, photo-typesetting machines employing CRT and photo-typesetting machines employing a laser scanner have been developed remarkably and have been widely placed in practical use due to the application of advanced electronics technology. The technical assignment, in this case, is concentrated to how cheaply the characters and figures can be reproduced while maintaining high quality. Generally, however, the system for storing characters and figures consists of digitizing a character to store it as detailedly described below with reference to FIG. 2. To obtain characters of high quality, therefore, they must be digitized or divided into great many number of dots, which contradicts the requirement for cheaply reproducing characters (with reduced memory capacity). From the standpoint of quality, furthermore, there is imposed limitation on the size of the character that is to be reproduced relying upon a predetermined number of dots. When characters of various magnifications are required, characters with different dot numbers must be prepared. In the Japanese language, furthermore, there exist several thousand to ten thousand characters in a single font only, and characters are often used in several fonts. Therefore, to store the characters which are digitized, is not practicable, and various systems for compressing the data have been proposed to cope with the inconvenience. In most of these systems, however, the characters are divided into a predetermined number of dots, and the dots are compressed. Therefore, different data must be stored depending upon the magnification of character, which contradicts the requirement for reducing the memory capacity.

Another system consists of storing the characters and figures in the form of contours. In this system, however, curves are approximated to straight lines. When the data is prepared based upon characters of a predetermined size, therefore, connection points(bending points) of straight line appear on an enlarged scale when larger characters are being treated, and the quality is deteriorated. Conversely, when attempt is made to obtain large characters maintaining high quality, the amount of data to be stored increases proportionately, to offset the meaning of data compression.

SUMMARY OF THE INVENTION

The present invention is intended to solve the above-mentioned defects, and its object is to provide a method of storing characters and figures based upon reduced amounts of data without deteriorating the quality irrespective of the change in magnification factor, as well as to provide an apparatus for photo-typesetting the characters and figures.

DESCRIPTION OF THE PREFERRED EMBODIMENT

Figure 1:
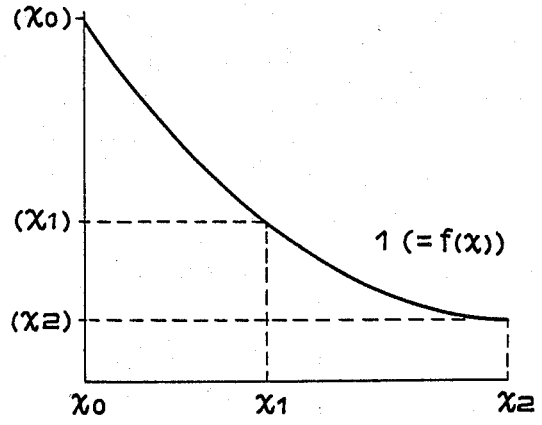
FIG. 1 is a diagram illustrating a method of interpolating a curve.

The invention will be described below in detail with reference to an embodiment shown in the drawings.

First, the principle of the invention will be illustrated below in conjunction with FIG. 1.

In the present invention, the character or figure is stored in the form of data of contours. Unlike the prior art, however, curves of contours are not approximated by straight lines, but curves are approximated by curves. Namely, the data is stored to obtain a curve which is approximated to the curve of contour. Curves approximated to contours such as of characters and figures can then be reproduced based upon the stored data. According to the present invention, therefore, curved portions of contours are given by curves irrespective of the magnification. Therefore, the quality of characters are not deteriorated, and the characters or figures can be reproduced relying upon a single kind of data irrespective of the magnification. Further, even contours having large radii of curvature are approximated by curves. As compared with the prior art of approximation by straight lines, therefore, the data need be stored in greatly reduced amounts.

Here, it is assumed that part (hereinafter referred to as contour element) of contour of a character or figure is a curve which is denoted by 1 in FIG. 1, and which is given by a function f(x). If the function f(x) is a quadratic function, it (f(x)) can be specified provided coordinates of at least three points on the contour element 1 are clarified, and the contour element 1 can be found by calculation. Further, with the three points on the contour element 1 being clarified, values on the contour element 1 can be calculated in the same manner by the interpolation method. Namely, when the contour element is given by the function f(x) of an n-th degree, the function f(x) can be found or coordinates on the contour element can be calculated by the interpolation method, provided coordinates of $(n+1)$ points on the contour element are clarified.

Relying upon the above-mentioned principle according to the present invention, curves of contours of figures or characters are transformed into functions of the n-th degree, which represent the curves or other curves that are approximated to the curves. Further, as the data which represent the functions, there are specified a coordinate of start point of the curve, a coordinate of end point of the curve and $(n-1)$ reference points corresponding to the degree of the functions, and these coordinates and reference points are stored as the data of contour elements. In the example of FIG. 1 in which the function f(x) representing the contour element 1 is assumed to be a quadratic function, therefore, the contour element 1 can be reproduced by simply storing three coordinates, i.e., by storing a coordinate of start point $(x_0, f(x_0))$, a coordinate of end point $(x_2, f(x_2))$, and an intermediate reference point $(x_1, f(x_1))$.

As mentioned above, the contour element can be calculated from the data of contour element by either finding functions of curves that represent contour elements, or by the interpolation method. With the method in which the functions are found and the calculations are effected, however, extended periods of time are consumed for finding the functions. Namely, this method is not advantageous when the high output speeds are required. Even in the interpolation method, operation must be carried out responsive to the degree, which, however, is not so cumbersome as to find the functions. Examples of interpolation method for calculating the contours can be divided into interpolation method by Aitken, interpolation method by Lagrange, etc. Among them, however, the interpolation method of Aitken can be relatively simply handled. According to this method, the equation of high degree is not prepared, but the interpolation (linear interpolation) using a linear equation is carried out repetitively. First, a value interpolated by a straight line that passes through two points $x_0$ and $x_i$ (i=1, 2, 3, . . . n), is found according to the following formula, $$f(x/x_0, x_i) = \frac{1}{(x_i - x_0)} = \begin{vmatrix} f(x_0)\ x_0 - x \\ f(x_i)\ x_i - x \end{vmatrix},$$

$i = 1, 2, \ldots n$

Then, a value interpolated by a quadratic function which passes through three points $x_0$, $x_1$, $x_i$ (i=2, 3, . . . n) is found according to the following formula, $$f(x/x_0, x_1, x_i) = \frac{1}{(x_2 - x_1)} = \begin{vmatrix} f(x/x_0, x_1)\ x_1 - x \\ f(x/x_0, x_i)\ x_i - x \end{vmatrix},$$

$i = 2, 3, \ldots n$

When the function f(x) has a higher degree, the value of degree is increased by a value interpolated by a cubic equation which passes through points $x_0$, $x_1$, $x_2$, $x_i$ (i=3, 4, . . . n), by a value interpolated by a biquadratic equation which passes through points $x_0$, $x_1$, $x_2$, $x_3$, $x_i$ (i=4, 5, . . . n), etc.

In the foregoing was mentioned the principle of the method of storing and reproducing characters and figures according to the present invention. Precisely speaking, however, the contours of characters and figures can be encoded according to the procedure mentioned below.

First, a character or a figure is scanned by a flying spot or taken into picture by a vidicon to digitize it into a set of dots of a suitable number. The digitized result is then corrected from the standpoint of design to form a correct shape. Contours only of the character or figure digitized are extracted and divided into contour elements. How to divide the contour into contour elements will be determined depending upon a point of inflection where a straight line changes into a curve or where a curve changes into a straight line, depending upon a position where the increment in the scanning direction is inverted, depending upon the degree of a function that represents a curve to which the contour elements should be approximated, or depending upon the degree to which the contour elements should be approximated. However, when the degree of a function is too great, or when the start point and the end point of the contour element are too close to each other, attention should be given to that increased amount of data which must be stored. Therefore, the best method consists of, first, arbitrarily dividing the contour, and finding values on the contour using suitable reference points to find a correlation relative to the practical contour.

The data determined for every contour element are then stored. The order of storing the data has a close relation to the method of producing output or to the setup of hardware of an output device. Namely, in CRT or laser scanner, in general, the characters and figures are reproduced by turning on and off the electron beam or laser beam while performing the raster scanning. In this case, the electron beam or the laser beam can be turned on and off relying upon the following three methods.

A. A coordinate which has been calculated beforehand to turn on and turn off the beam is compared at all times with the present position of the scanning beam. When they are in agreement, the beam is turned on or off.

B. A shift register for one scanning line or a line buffer is provided to write signals at positions for turning on and off the beam, and the shift register is shifted or the content of the line buffer is read out in synchronism with the scanning of the scanning line to form video signals.

C. A buffer memory having a capacity of one character is prepared, contours reproducing the character or figure are written onto the buffer memory, and the content is read out in synchronism with the scanning of scanning line as in B. above to form video signals.

To put the method A into practice, the contour elements must be stored according to the scanning order of scanning lines. In the method B, the contour elements which intersect a scanning line must all be reproduced irrespective of the scanning order. In the case of the method C, the contour elements may be stored in any order provided the contours of one character are reproduced. Therefore, if the contours are decoded according to the method A, the contours of a character digitized as shown in FIG. 2 are stored according to the order mentioned below.

Figure 2:
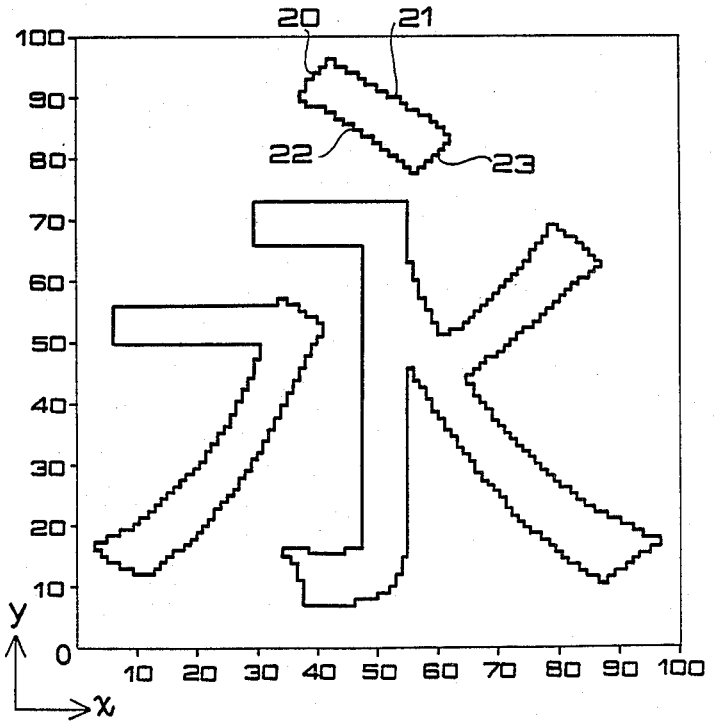
FIG. 2 is a diagram illustrating a normalized X·Y grid with the contour of a Chinese character " 𠂤 " [ei] superimposed thereon.

Namely, FIG. 2 shows by way of example, a greatly enlarged version of Chinese character "氷" superimposed on a grid or matrix of horizontal and vertical lines. Each character or figure that is recorded is located on such a grid. Horizontal and vertical resolutions are indicated to be the same in FIG. 2, but this is not necessary. The character may be any kind (alphabetical characters, numerals, Japanese characters, character width, etc. in addition to Chinese characters). Each character or figure is also considered to include a "white space" about the character.

The line in the grid shown in FIG. 2 may be represented (numbered) by the X and Y coordinates of a Cartesian coordinate set. Any point within the grid may be designated by the coordinates (X·Y) of the nearest intersection of a horizontal and vertical line. The leftmost vertical edge of the character zone is designated X=0 and the horizontal edge is designated Y=0.

When a character, such as the Chinese character "氷" shown in FIG. 2, is to be digitally encoded it must first be plotted onto the grid in such way that all values of X and Y are represented as integers. As shown in FIG. 2, the outline of the character "氷" are plotted by choosing the closest intersection points on the grid. Each of these points may thus be represented by its X·Y coordinates, where X and Y are integers. It is therefore possible to completely define—i.e., digitally encode—the character by listing all of these coordinates, preferably in some ordered sequence.

In FIG. 2, the character is divided into 100×100 dots. Here, let it be assumed that the aforementioned data have been corrected (design has been corrected), contour elements have been determined, data have been determined for each contour element, and the scanning is effected from the left toward the right, and from the upper direction toward the lower direction. In this case, "冫" in the upper portion of the character "氷" is scanned, first, in FIG. 2. Therefore, contour elements 20, 21, 22, 23 of "冫" are stored in the order of 20, 21, 22 and 23 according to the scanning order of scanning lines. Namely, the scanning line which crosses the contour at an end of the character necessarily crosses the contour element on the opposite side which corresponds to the above-mentioned contour element, so that the contour elements are stored in the form of pairs. However, when the contour elements of the first pair are short as denoted by 20, the end point of the contour element 20 and the contour element 22 are stored simultaneously.

In the foregoing was mentioned the method of storing characters and figures according to the present invention. Below will be described an example of a photo-typesetting apparatus which has a memory device to store characters and figures that have been encoded by the above-mentioned storing method, and which decodes the contents to print them, in conjunction with FIGS. 3, 4 and 5.

Figure 3:
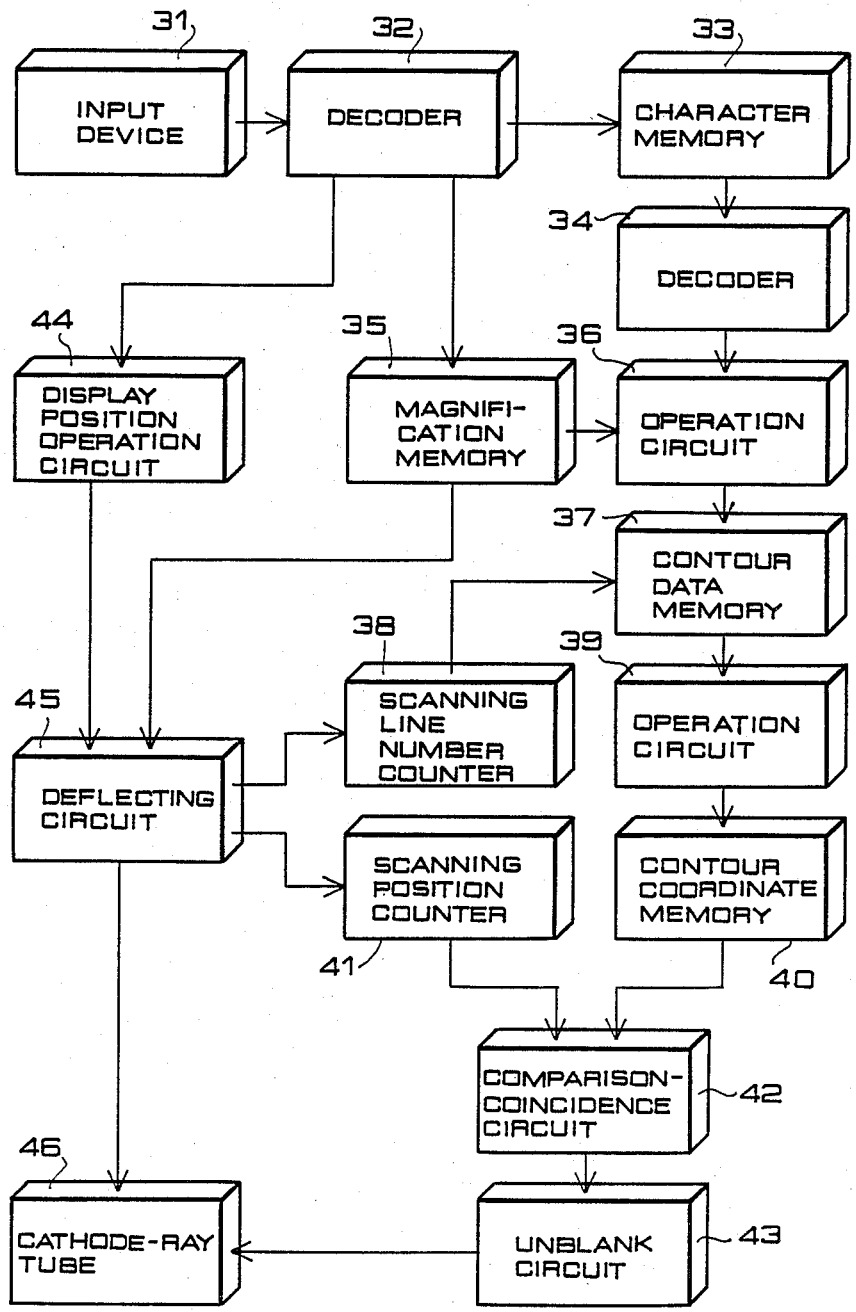
FIG. 3 is a block diagram showing major portions of an apparatus for storing characters and figures, which is equipped with a buffer memory for one scanning line according to an embodiment of the present invention.
Figure 4:
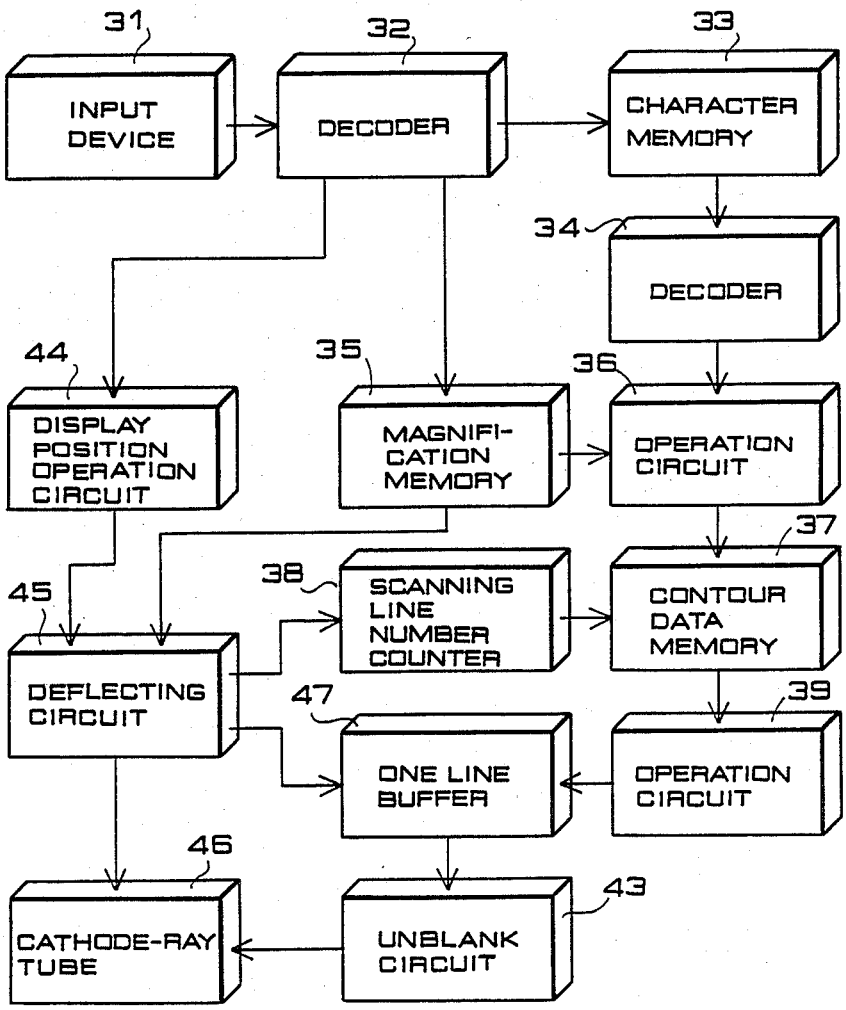
FIG. 4 is a block diagram which illustrates a method of gaining coincidence with a counter.
Figure 5:
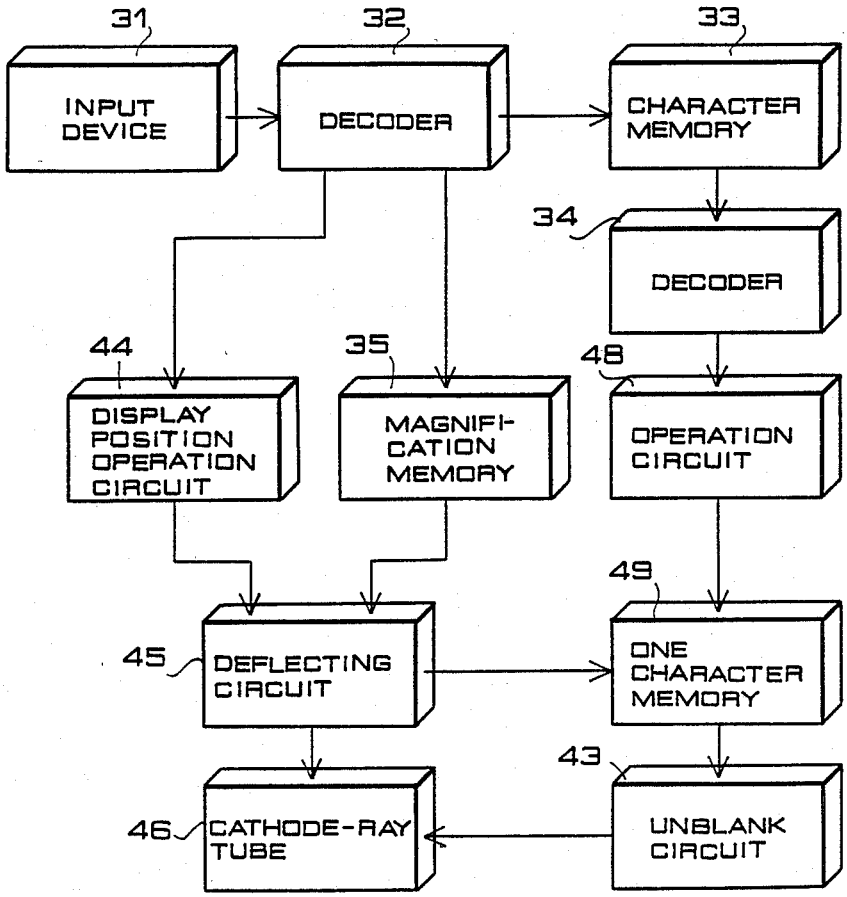
FIG. 5 is a block diagram of the apparatus equipped with a contour data memory for one character (or more characters).

FIGS. 3, 4 and 5 illustrate photo-typesetting apparatus which are constructed to be adapted to the aforementioned methods A, B and C of turning on and off the electron beam or laser beam. In these figures, the common elements are denoted by the same reference numerals. That is, reference numeral 31 denotes an input device which indicates a character that is to be printed, 32 denotes a first decoder which decodes the data such as address storing the data of the character as instructed by the input device 31, magnification of character, and position of character to be printed, 33 denotes a character memory which stores the data of characters relying upon the aforementioned storing method, 34 denotes a second decoder which decodes the data of a desired character read from the character memory 33 into coordinates of a start point, an end point and a reference point of contour element, 35 denotes a magnification memory which stores the magnification (contraction) of character decoded by the first decoder 32, 36 denotes a first operation circuit which multiplies values of contour coordinates decoded by the second decoder 34 by the magnification stored in the magnification memory 35, 37 denotes a contour data memory which stores the operation results of the first operation circuit 36, 38 denotes a scanning line counter which counts the number of scanning lines produced by the CRT or laser scanner, 39 denotes a second operation circuit which reads the data of contour running over a position of a scanning line number indicated by the scanning line counter 38 from the contour data memory 37 to calculate the position of contour coordinates on the scanning line, 40 denotes a contour coordinate memory which stores positions of contour coordinates on the scanning lines calculated by the second operation circuit 39 according to the order of scanning, 41 denotes a scanning position counter which counts the present position of scanning beam, 42 denotes a coincidence circuit which compares the content of the contour coordinate memory 40 with the content of the scanning position counter 41 and which produces the output when the two contents are in agreement, 43 denotes an unblanking (or modulation) circuit which controls the blank or unblank of the CRT or the laser scanner, 44 denotes a display position operation (control) circuit which calculates a position where the character is to be displayed upon receipt of a signal from the first decoder 32, 45 denotes a deflecting circuit which controls the CRT or the deflection of laser scanner, or which detects the quantity of deflection, and 46 denotes a CRT or a laser typesetting device.

In FIG. 4, reference numeral 47 denotes a noe-line buffer made up of a buffer memory or a shift register having a capacity of one scanning line. In FIG. 5, reference numeral 48 denotes an operation circuit having the functions of the first operation circuit 36 and the second operation circuit 39 of FIGS. 3 and 4. The operation circuit 48 works to multiply the contour data decoded by the second decoder 34 by the magnification, and to calculate coordinates in which the contours cross the scanning lines. Reference numeral 49 denotes a one-character memory having a capacity of one or more characters. Contours calculated by the operation circuit 48 are written into the memory circuit where the original character is reproduced.

In the above description, position for displaying character, magnification of character, and contour coordinates were all calculated using separate operation circuits. The above calculations, however, may be performed using a single operation circuit.

In the thus constructed photo-typesetting apparatus, the data of character, size of character, and display position, are introduced through the input device 31, and are decoded in the first decoder 32 where address storing the character is sent to the character memory 33, data related to the size of character is sent to the magnification memory 35, and the data related to the display position is sent to the display position operation (control) circuit 44. Then, the data of character is read responsive to the address signal sent to the character memory 33, and is sent to the first operation circuit 36 via decoder 34. The first operation circuit 36 multiplies the data by a magnification (contraction) of character stored in the magnification memory 35, and the result is sent to the contour data memory 37. On the other hand, the data sent to the display position operation (control) circuit 44 and to the magnification memory 35 are further sent to the deflecting circuit 45 and are so deflected that the character will be displayed at a desired position. The scanning line counter 38 counts the number of scanning lines responsive to the signals from the deflecting circuit 45, and the scanning position counter 41 counts the present position of the beam. Therefore, the contour data memory 37 reads the data of contour element which crosses the scanning line that corresponds to a counted value of the scanning line counter 38 according to the order of scanning after every count, and the second operation circuit 39 calculates the coordinate in which the contour element crosses the scanning line by the interpolation method, and sends the coordinate to the contour coordinate memory 40. Thereafter, the comparison-coincidence circuit 42 compares the content of contour coordinate memory 40 with the content of scanning position counter 41, and sends a signal to the unblanking circuit 43 when the two contents are in agreement, thereby to control the brightness of electron beam of CRT or of laser scanner. Thus, as the first contour position is brought into agreement, the coordinate in which the scanning line crosses another contour element of the pair of contour elements is calculated. In the same manner, another contour element, and contour element that crosses the next scanning line, are calculated. The above-mentioned operation is repeated successively.

In the foregoing was mentioned a decoding method relying upon the above-mentioned method A, in which the coordinate where a contour element crosses a scanning line was compared with the present position of the scanning beam, and the coincidence signal was utilized as a video signal. In the case of FIG. 4 equipped with the one-line buffer 47 having a capacity of one scanning line, the coordinate in which the contour crosses the scanning line that is calculated by the second operation circuit 39, should be written onto the line buffer 47, and should thereafter be read out in synchronism with the scanning of the scanning lines to form video signals. In the case of FIG. 5 equipped with the one-character memory 49 having a capacity of one or more characters, the result of calculation should be written onto the one-character memory 49, and a video signal should be obtained when the contours of one character are all written. In the cases of FIGS. 4 and 5, there is no definite order for storing the contour elements.

Although the foregoing embodiment has dealt with "kanji" (Chinese character), it will be obvious that the present invention is applicable to characters of any other languages.

According to the present invention as described above, the characters and figures are stored in the form of contours approximated to curves. Therefore, the quality is not deteriorated at any magnification, and the data of a single kind only are required at any magnification. Further, since curves are approximated by curves, reduced amounts of data are required as compared with when curves are approximated by straight lines.

What is claimed is:

1. A photo-typesetting apparatus comprising:

(a) A character-figure memory means for dividing contours of characters and figures at suitable positions into a plurality of contour elements, said character-figure memory means obtaining coordinate information of $(n+1)$ points on each respective contour element, wherein $n \geqq 2$ consisting of at least a start point and an end point of each said contour element, and of arbitrary points numbering $(n-1)$, wherein $n \geqq 2$, existing on each said contour element, said points comprising contour element data defining said contour elements, said character-figure memory means storing said contour element data concerning all contour elements constituting said characters and figures, (b) a character-figure generator means for forming said characters and figures by scanning of an energy beam, (c) an operation circuit means for calculating coordinate information in which the contour element crosses a scanning line formed by said character-figure generator means from the coordinate informations of each said point defining each contour element which is read out from said character-figure memory means, and (d) unblanking circuit means for controlling the activation and deactivation of said energy beam, in response to the results calculated by said operation circuit means.

2. A photo-typesetting apparatus according to claim 1, wherein said character-figure memory means stores said contour element data in the same order as the order in which the respective contour elements are generated when said character-figure generator means effects a raster scanning to form characters and figures.

3. A photo-typesetting apparatus according to claim 1, further comprising a one-line buffer means which has a capacity of one scanning line formed by the beam and which stores the results calculated by said operation circuit means.

4. A photo-typesetting apparatus according to claim 1, further comprising a reproducing memory means which has a capacity of one or more characters, which writes contour elements calculated by said operation circuit, and which reproduces the state of an original character or figure.

5. A photo-typesetting apparatus according to claim 1, whichin said operation circuit means derives an n degree equation that represents a corresponding contour element, said derivation relying upon said contour element data, said operation circuit means calculating coordinate information on the corresponding contour element by relying upon said n degree equation.

6. A photo-typesetting apparatus according to claim 1, wherein said operation circuit means finds a coordinate on a contour element by an interpolation method, relying upon said contour element data.

7. A photo-typesetting apparatus according to claim 1, further including contour coordinate memory means for storing the coordinate informations calculated by said operation circuit means.

* * * * *